US006886381B2

(12) United States Patent
Geurden

(10) Patent No.: US 6,886,381 B2
(45) Date of Patent: May 3, 2005

(54) ACTUATING DEVICE FOR A LOCK, ESPECIALLY IN A MOTOR VEHICLE

(75) Inventor: Armin Geurden, Grefrath (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/312,376

(22) PCT Filed: Apr. 14, 2001

(86) PCT No.: PCT/EP01/04268

§ 371 (c)(1),
(2), (4) Date: Dec. 24, 2002

(87) PCT Pub. No.: WO02/01026

PCT Pub. Date: Jan. 3, 2002

(65) Prior Publication Data

US 2003/0136163 A1 Jul. 24, 2003

(51) Int. Cl.[7] ..... E05B 27/00; E05B 29/00; E05B 33/00

(52) U.S. Cl. ..... 70/360; 70/379 R; 70/223

(58) Field of Search ..... 70/360, 379 R, 70/387, 223, 422

(56) References Cited

U.S. PATENT DOCUMENTS

| | | | | |
|---|---|---|---|---|
| 3,200,623 A | | 8/1965 | Peters | 70/279 |
| 3,529,452 A | * | 9/1970 | Rae | 70/240 |
| 4,194,377 A | * | 3/1980 | Maeda | 70/360 |
| 4,689,977 A | * | 9/1987 | Wolniak et al. | 70/379 R |
| 4,947,664 A | * | 8/1990 | Lindmayer et al. | 70/422 |
| 5,263,348 A | * | 11/1993 | Wittwer | 70/379 R |
| 6,439,016 B1 | * | 8/2002 | Wittwer et al. | 70/379 R |

FOREIGN PATENT DOCUMENTS

| | | |
|---|---|---|
| DE | 197 46 381 C1 | 1/1999 |
| EP | 0191738 | 8/1986 |

* cited by examiner

*Primary Examiner*—John B. Walsh
(74) *Attorney, Agent, or Firm*—Friedrich Kueffner

(57) ABSTRACT

The invention relates to an actuating device for a lock, especially a lock on the parcel shelf of a motor vehicle, comprising an actuating element (30) and a transmission element (20) which can be moved in a linear manner (20) and on which a catch device (21) is disposed, whereby the movement thereof impinges upon a trigger element (12) which interacts with an actuating rod assembly. The transmission element (20) is embodied as an axially displaceable shaft (20) which can be rotated by means of a central locking device (11) and is provided with an eccentrically arranged extension (22). One area of the actuating element (30) can be rotated by means of a locking cylinder (31) and is provided with an eccentrically arranged extension (32). The front faces (23, 32) of the extensions (22, 32) face each other and overlap in at least one rotational position but not in all relative rotational positions of the extensions (22,32). No overlapping of the front faces (22,32) occurs, however, in at least one rotational position of one of the extensions (22,32), irrespective of the adjustable rotational position of the other extension. Preferably, a locking plate (40) is arranged between the actuating element and the transmission element. Said locking plate has a recess (41) whose shape enables engagement of the extension (32) of the actuating element (30) in at least one but not all of the rotational positions provided.

20 Claims, 3 Drawing Sheets

ACTUATING DEVICE FOR A LOCK, ESPECIALLY IN A MOTOR VEHICLE

BACKGROUND OF THE INVENTION

1. Field of the Invention

The invention pertains to an actuating device for a lock, especially in a motor vehicle. In these types of actuating devices, a transmission element is moved in linear fashion by the actuation of an actuating element, which is frequently designed as a sensor pin, which can be shifted in linear fashion. Depending on the design, the transmission element represents either an integral extension of the actuating element or an independent component. A catch device is provided on the transmission element; this catch device transmits the movement of the transmission element to a release element such as a reversing lever, which is in working connection with the lock by way of an actuating linkage such as a Bowden cable.

2. Description of the Related Art

In many cases, these types of actuating devices can be secured. In particular, central locking devices are often provided, by means of which locking elements can be moved in such a way that the movement of the actuating and/or of the transmission element and/or of the release element is blocked.

An actuating device for a lock is known from DE 198 31 944 C1. The lock cylinder, which is installed in a cylinder housing and supported with the freedom to rotate, is connected to a lever housing. The two elements are installed in such a way that they can move in the axial direction in either the unlocking or the locking position of the lock cylinder. A second cam is provided inside of the lever housing. The first cam can be pushed along as well both in the unlocking position and in the locking position of the lock cylinder. In an intermediate position, the second cam prevents the axial displacement of the lock cylinder. This state of the art suffers from various disadvantages. Because one or more of the movable parts are prevented from moving, there is the danger that they can be destroyed when force is applied to the actuating element. If, furthermore, the locking element (the cam) turns out to be the weakest element in the chain of components effectively connecting the actuating element to the lock, the use of force leads to the breakage of the locking element and to the unauthorized release of the lock mechanism. Another disadvantage of the known devices is that the vehicle can be secured either only by the use of the central locking unit acting in common on all the locks of the vehicle or by acting individually on each lock. The latter variant has the disadvantage of being inconvenient for the user, which experience has shown leads to the user's failure to make use of the ability to secure an individual lock, e.g., that of the glove compartment or of some other lockable storage compartment. The ability to lock such compartments is especially important in the case of convertibles, however. In the case of the former variant, furthermore, anyone in possession of the central locking release unit, e.g., a radio transmitter, at the time is able to open simultaneously all the locks of the vehicle connected to the central locking system. This, however, is frequently undesirable. Thus, for example, it is necessary at hotels or repair shops, where third parties must move the vehicle, to allow such parties access to the interior of the vehicle. At the same time, it would be favorable for the storage compartments to remain locked, so that personal objects could be securely protected from access by third parties.

SUMMARY OF THE INVENTION

The task of the invention is to make available an actuating device of the type described above which allows an authorized user to activate conveniently the securing function via the central locking unit, but which at the same time gives him the ability to allow unauthorized users access only to selected areas. Another task of the invention is to design the actuating device in such a way that, even if excessive force is applied to the actuating element, there is no danger that the lock can be opened without authorization. Attempts to open the lock improperly are to be prevented more reliably, and the absolute distances by which the lock is adjusted or turned are to give the user the impression of a precision mechanism.

In accordance with the invention, the transmission element is a shaft, which is supported with freedom of both axial movement and rotation. The rotation of this shaft is accomplished by a first securing device, preferably a central locking unit. The actuating element has an area which can be rotated independently of the shaft and its securing device by means of a second securing device, preferably a cylinder lock. Each of these two elements has at least one eccentric extension, and the end surfaces of these extensions are arranged to face each other. The actuation of one of the securing devices provided has the effect of changing the relative rotational position of the two opposing, facing extensions. It is provided in accordance with the invention that the end surfaces of the extensions overlap in certain relative rotational positions, whereas, in other rotational positions, they do not overlap. When the actuating element is actuated while it is in an overlapping position, the extension of the rotating area of the actuating element comes up against the end surface of the shaft extension. As a result, the movement of the actuating element can be converted into the linear movement of the axially movable shaft. When the actuating element is actuated while in a nonoverlapping position, however, it extension does not come up against a stop, for which reason no axial movement of the shaft which could release the lock mechanism takes place. The overall device therefore serves a securing function in all of the nonoverlapping positions. Increasing the amount of force being applied to the actuating element cannot lead to the destruction of this element and forcibly activate the lock mechanism.

The independent rotational ability of the shaft and of the rotating area of the actuating element makes it possible for one of the extensions, preferably that of the actuating element, to be moved to an absolute rotational position in which no overlapping with the other extension is possible, no matter which of its predetermined absolute positions the other extension may be occupying. In this position, which is referred to below as the "hotel position", the vehicle can be moved by any third party in possession of a release device for the central locking system, whereas personal objects stowed in a compartment equipped with the actuating device according to the invention are securely protected. When the extension of the actuating element is in another rotational position, which can be selected by the authorized user and which is referred to below as the "normal position", however, the overlap depends on the absolute position of the shaft extension, so that the storage compartment equipped with the actuating device according to the invention can be secured or released jointly by the central locking unit.

To accomplish this task, it is proposed according to the invention in correspondence with the characterizing clause of claim 2 that a nonrotatable locking disk be installed axially between the extensions, this disk being provided with an opening, the shape of which allows the extension of the actuating element to pass through only when this extension is in certain absolute rotational positions, whereas the extension is mechanically prevented from passing through in all other rotational positions. This design offers the following advantages:

If the extension of the actuating element is in an "allowed" position and the actuating element is actuated, the extension will be able to pass through the opening in the locking disk and strike the extension of the axially movable shaft if the shaft is in the proper absolute rotational position, as a result of which the lock mechanism can be released. If, while this working connection is established, the rotating area of the actuating element were to be turned by mistake, the end surfaces of the extensions could slide off each other, which would lead to a malfunction. The positive engagement of the extension of the actuating element in the opening of the nonrotating locking disk, however, effectively prevents the actuating element from rotating. A malfunction is thus excluded. In addition, the provision of the locking disk has the result that the extension itself can pass through only in the "allowed" position or positions, that is, only after it has traveled an absolute rotational distance. This gives the user an enhanced impression of a precision mechanism.

BRIEF DESCRIPTION OF THE DRAWINGS

Additional advantages of the invention can be derived from the subclaims, from the detailed description, and from the drawings:

DESCRIPTION OF THE PREFERRED EMBODIMENTS

Figure 1:
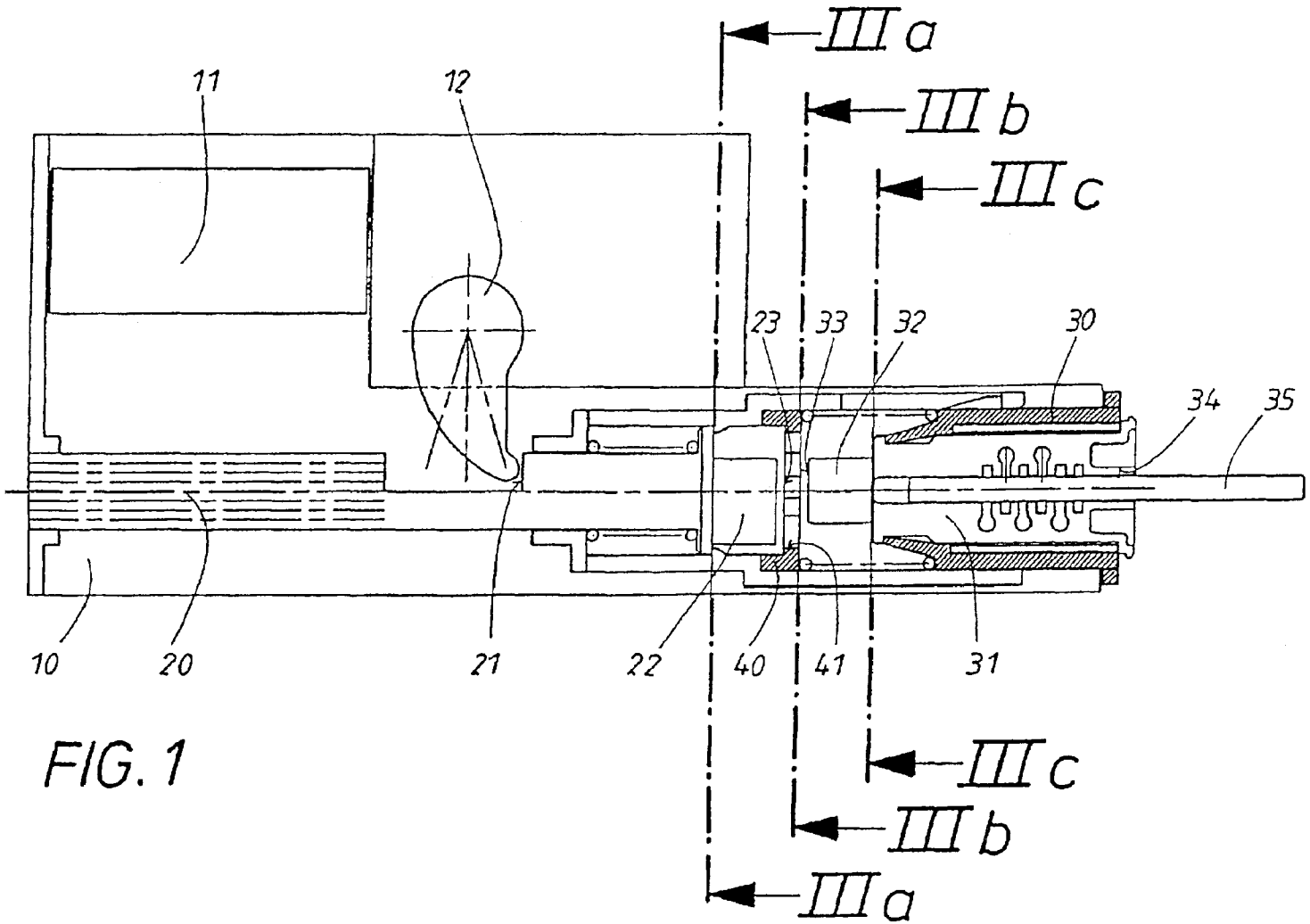
FIG. 1 shows a cross section through an actuating device according to the invention.
Figure 2:
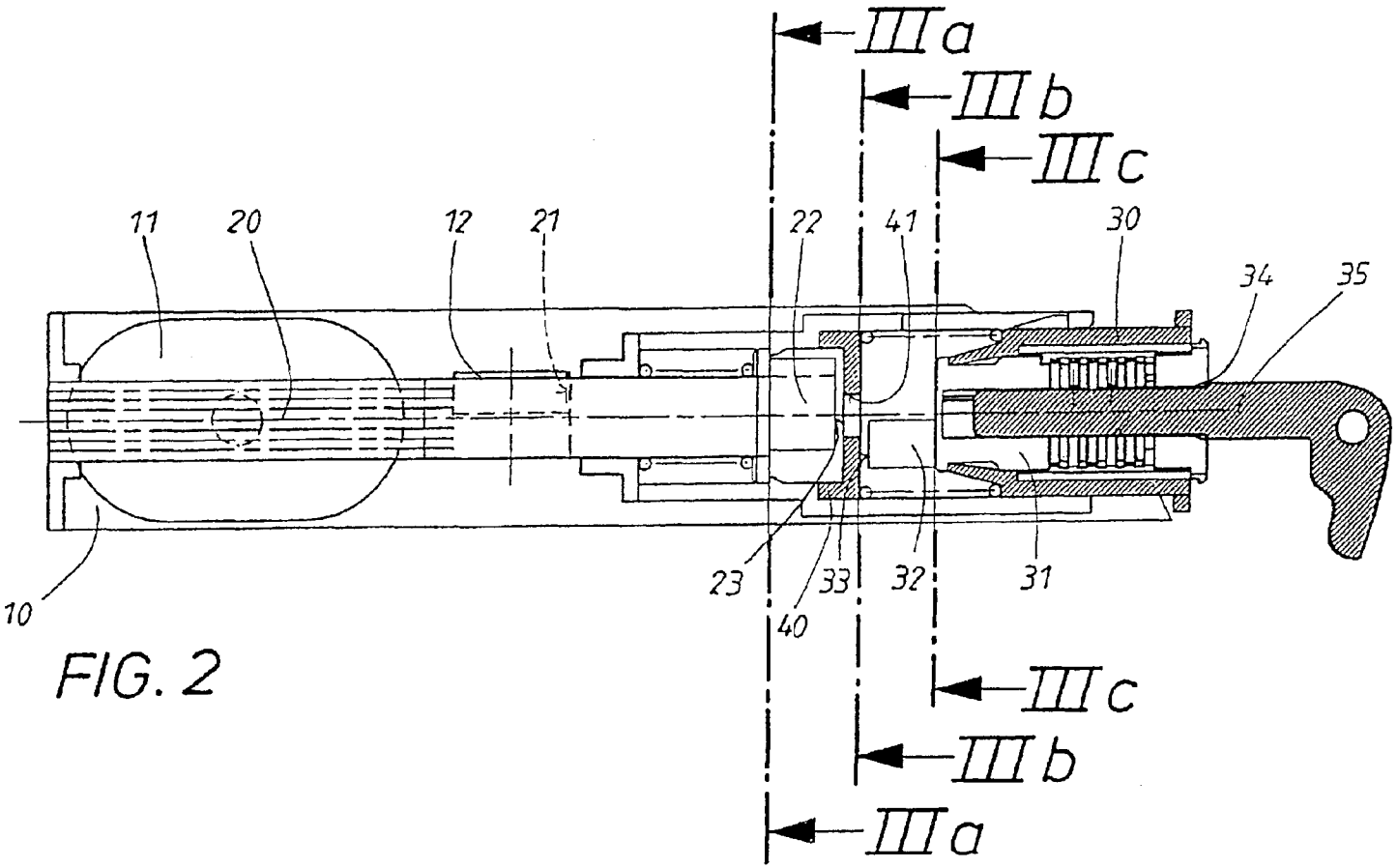
FIG. 2 shows another cross section through an actuating device according to the invention after rotation by 90° in comparison with FIG. 1.
Figure 5:
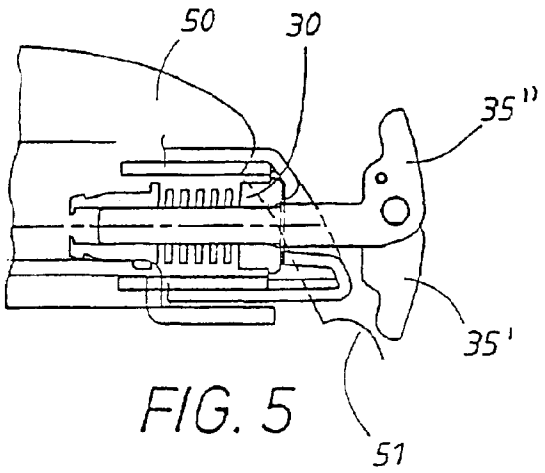
FIG. 5 shows a cross-sectional diagram of an actuating device according to the invention, installed in a dashboard of especially advantageous design.

In the cross-sectional drawing of FIG. 1, the essential elements of an especially advantageous embodiment of an actuating device according to the invention can be clearly seen. An axially movable shaft 20 and an actuating element designed as a push button 30 are provided in a housing 10. A locking plate 40 with a central opening 41 is supported nonrotatably between the shaft the actuating element. The rotatable area of the actuating element is designed as a lock cylinder 31 of a cylinder lock, which is integrated into the push button 30. The cylinder lock can be actuated by a mechanical key 35, which can be inserted into the key slot 34. An extension 32 is provided on the lock cylinder 31 in the form of an axial projection, the eccentricity of which cannot be seen in FIG. 1 but is clearly recognizable in FIG. 2. Upon actuation, that is, when the push button 30 is pushed in, the extension 32 can pass through the opening 41 in the locking disk 40 if it is in a suitable, absolute rotational position. On the other side of the locking disk, it strikes an extension 22, also eccentric, of the shaft 20. Upon continuation of the pushing-in movement, the shaft 20 is displaced in the axial direction, and the catch device 21 begins to interact with the release element, indicated schematically as a reversing lever 12. Not shown in FIGS. 1 and 2 is an actuating linkage, which establishes the working connection between the release lever 12 and the lock (not shown). The central locking unit 11, by means of which the shaft 20 can be turned, is also indicated in merely schematic fashion.

Figure 4:
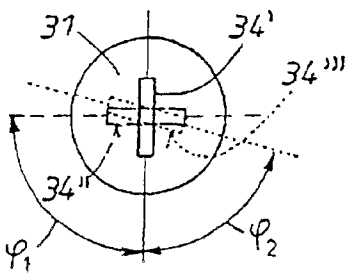
FIG. 4 shows a top view of the rotating cylinder of an actuating device according to the invention with the various rotational positions of the key slot.
Figure 3:
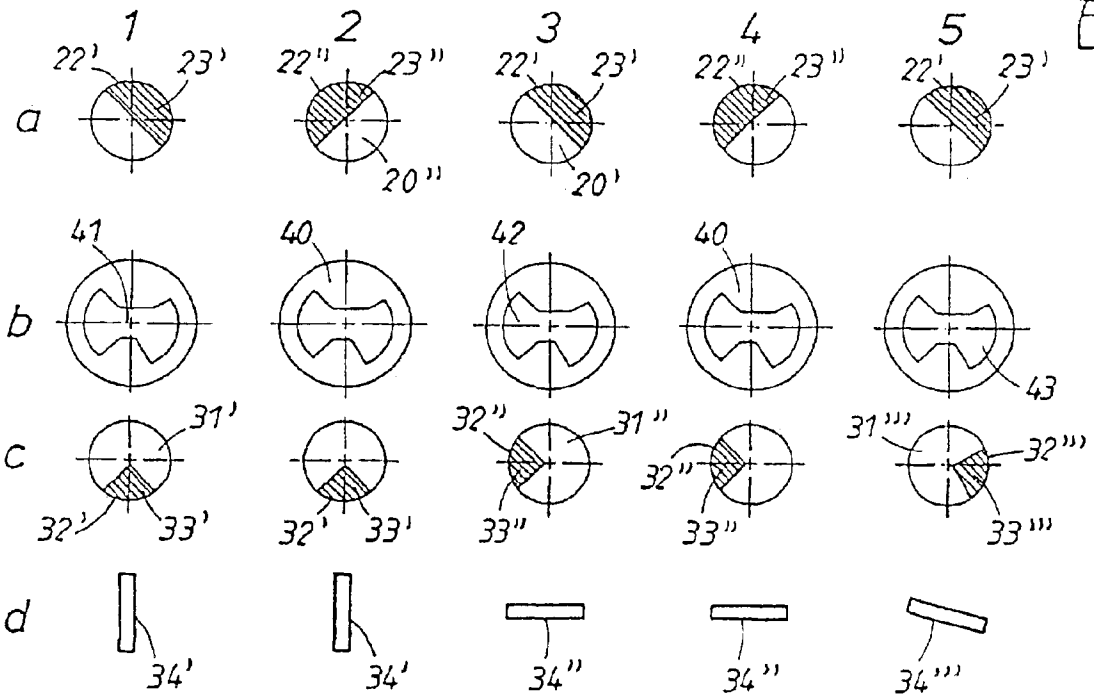
FIG. 3 shows a diagram of the possible constellations of rotational position in an especially advantageous embodiment, where the cross sections a, b, and c correspond to the cross-sectional lines IIIa, IIIb, and IIIc in FIGS. 1 and 2.

FIG. 3 clearly shows the various constellations of rotational positions which the shaft 20 and the lock cylinder 3 can assume in an especially advantageous embodiment of the invention. Numbers 1–5 designate here the various constellations, whereas the letters a–c refer to the corresponding cross-sectional planes, labeled IIIa, IIIb, and IIIc in FIGS. 1 and 2. Row a, therefore, shows the position of the shaft extension 22 with its shaded end surface 23. Row b shows the nonrotatably mounted locking disk 40 with its opening 41, which, in the embodiment shown, consists essentially of two areas, namely, the unlocking area 42 and the special area 43, the special functions of which will be described below. Row c represents a schematic diagram of a cross section through the lock cylinder 31 with its extension 32 and especially its shaded end surface 33. Row d symbolizes the positions of the key slot 34 provided for in this illustrated embodiment. A top view onto the lock cylinder 31 with the various positions of the key slot 34 can be found in FIG. 4.

Constellations 1 and 2 in FIG. 3 show the two locations of the individual elements which can be reached in the "hotel position". In row c, the end surface of the cylinder extension is shown in its "hotel position" 33'. In this position, it is not possible to depress the push button, because the end surface 33' comes up against the locking plate 40 and is thus unable to pass through its opening 41. The locking plate 40, however, does not represent the actual securing mechanism here, because in this position, even if the locking plate 40 were absent or if the plate were destroyed by the use of excessive force, it would still be impossible for a working connection to be established with the end surface 23 of the shaft 20, no matter what position the end surface of the shaft extension is occupying, i.e., either the locking position 23' (constellation 1) or the unlocking position 23" (constellation 2). If the cylinder is in the "hotel position" 33', it is therefore possible, without compunction, to entrust a third party, such as a hotel porter, with the release device for the central locking system, e.g., a remote-control radio unit, so that this third party can move the vehicle. Nevertheless, it will not be possible for this party to gain access to personal objects which have been stored in a compartment equipped with the actuating device according to the invention.

Constellations 3 and 4, however, are provided for "normal operation". The end surface of the cylinder extension is here in its "normal position" 33". In this rotational position, the extension 32" can pass through the opening 41 in the locking plate 40, namely, through its unlocking area 42, when the push button 30 is actuated. Whether here a working connection with the shaft extension 22 and thus a release of the lock mechanism is achieved depends only on the rotational position of the shaft 20. If, namely, the shaft extension is in the locking position 22' (constellation 3), the actuation of the push button 30 will not lead to the opening of the lock. If the shaft extension, however, assumes its unlocking position 22" (constellation 4), the lock will be opened when the push button 30 is pressed. It is impossible for the mechanism to malfunction by mistakenly rotating the lock cylinder 31 while the working connection is established. This is because the unlocking area 42 of the locking plate opening 41 is advantageously designed in such a way that the extension 32" can pass through it in an essentially positive or form-locking manner. This therefore effectively prevents the lock cylinder 31 from turning.

The relatively high complexity of constellations 1–4 is made possibility by the shape of the extensions 22 and 32 and by the absolute rotational positions of the shaft 20 and of the lock cylinder 31 which can be realized. The end surface 23 of the shaft extension 22 is shaped in such a way that it lies only in one of the two half-planes which are separated from each other by a straight line intersecting the rotational axis at a right angle. As in the embodiment shown in figures, this is advantageously realized by giving the end surface 23 an approximately semi-circular shape. Care must nevertheless be taken to ensure that the chord of the approximately semicircular section is set back slightly from the diameter of the circle. If this is done, the possibility can be excluded that, in a position in which there is not supposed to be any overlap, manufacturing tolerances, for example, could cause the one extension to overlap the other extension 32 along the diameter of the circle or especially at the center of the circle.

The end surface 33 of the cylinder extension 32, however, is advantageously designed in such a way that it lies only in one of the four quarter-planes separated from each other by two straight lines intersecting the rotational axis and each other at right angles. It is advantageous in particular for the end surface 33, as in the case of the embodiment shown in the figures, to have the approximate shape of a quarter-circle. Here, too, care should be taken to ensure that the end surface 33, especially at its tip, does not extend all to the way to the diameter of the circle and especially not to the rotational axis. The reasons for this are analogous to those explained above.

If both extensions can now be turned, independently of each other, into either one of two different rotational positions 90° apart, it is possible to realize constellations 1–4.

In the especially advantageous embodiment shown in the figures, an additional constellation 5 is provided. This is characterized especially in that the cylinder extension can be moved to a special position 32'", in which its end surface 33'" partially overlaps the end surface 23' of the shaft extension 22' in the locking position of the shaft. So that a working connection can be established in this special position between the extensions 32'" and 22', a special area 43 of the opening 41 is provided in the locking disk 40; this special area allows the extension 33'" to pass through. This advantageous elaboration is suitable especially for convertible vehicles. If, namely, the vehicle has already been locked by way of the central locking system and the user now wants to open a storage compartment provided with an actuating device according to the invention without having to actuate the central locking system, he can do this by taking advantage of the special position, which is also characterized by the position 34'" of the key slot 34. To avoid malfunctions, it is advantageous for it to be impossible to pull the mechanical key 35 out when it is in this special position 34'" of the key slot. To facilitate matters even more, an automatic return function back to the "normal position" 34 of the key slot can be realized by the use of a spring, for example.

Finally, it is also advantageous to install the actuating device according to the invention in a dashboard 50, which has a projection 51 in the area of the actuating device. An additional, purely mechanical safety measure can be taken, furthermore, by shaping the mechanical key 35 in such a way that, when its handle is in the "normal position" 35", it will not collide with the dashboard 50 when it is pushed in, whereas, when it is in the "hotel position" 35', it will collide with the projection 51 when pushed in. In this embodiment, the locking disk 40 also assumes an additional function. Because it prevents insertion in position 35' in any case, the surface of the projection 51 is normally protected from mechanical damage by the key 35'. When force is applied, the collision between the key 35' and the projection 51 offers an additional safety measure.

Of course, other embodiments of the actuating device according to the invention are also possible. In particular, it is not necessary for the rotating area of the actuating element to be designed as a lock cylinder 31. Rather, it is conceivable that an electrical lock could be provided here, which, for example, can be actuated by a special function of a radio remote-control unit. Here, too, it is not necessary for the actuating element to be designed as a push button 30. Instead, the features essential to the invention can also be realized in designs such as lever elements or the like. Finally, the locking plate 40 does not have to be designed as a separate plate, as shown in FIGS. 1 and 2. Instead, it is possible and often for cost reasons advantageous for the locking plate 40, or at least certain parts of it, to be designed as a suitably formed projection of the housing 10.

List of Reference Numbers

10 housing
11 central locking component
12 release lever
20 axially movable shaft
20' 20 in the locking position
20" 20 in the unlocking position
21 catch device on 20
22 eccentric extension of 20
22' 22 in the locking position
22" 22 in the unlocking position
23 end surface of 22
23' 23 in the locking position
23" 23 in the unlocking position
30 push button
31 lock cylinder
31' 31 in the "hotel position"
31" 31 in the "normal position"
31'" 31' in the special position
32 eccentric extension on 31
32' 32 in the "hotel position"
32" 32 in the "normal position"
32'" 32 in the special position
33 end surface of 32
33' 32 in the "hotel position"
33" 32 in the "normal position"
33'" 32 in the special position
34 key slot
34' 34 in the locking position
34" 34 in the "normal position"
34'" 34 in the special position
35 key
35' in the "hotel position"
35" 35 in the "normal position"
40 locking disk
41 opening in 40
42 unlocking area of 41
43 special area of 41
50 dashboard
51 projection $\phi_1$ rotational angle $\phi_2$ rotational angle

What is claimed is:

1. Actuating device for a lock, especially in motor vehicle, comprising:

an actuating element (30) and a transmission element (20);

where a catch device (21) is provided on the transmission element (20) to transmit the movement of the transmission element to a release element (12), which cooperates with an actuating linkage for the lock;

where the transmission element is an axially movable shaft (20) with an eccentrically located extension (22), which shaft can be turned from one of several rotational positions to another by a first securing device (11);

where the actuating element comprises an area (31) with an eccentrically located extension (32), which area can be turned from one of several rotational positions to another by the action of a second securing device and is also able to shift approximately in the axial direction;

where the end surfaces (23, 33) of the extensions face each other and overlap each other in at least one, but not in every, adjustable relative rotational position, whereby in the overlap position an operative connection is formed between the actuating element (30) and the transmission element (20) via contact of the end surface (23) on the end surface (33); and in at least one further, adjustable, relative rotational position of the extensions (22, 32) there is no overlapping of the end surfaces (23, 33) and in this non-overlapping position there is no operative connection between the actuating element (30) and the transmission element (20), whereby this non-overlapping position in an adjusted position gives up one of the extensions (22, 32), regardless of which adjustable rotational position the other extension (33, 23) happens to occupy.

2. Actuating device according to claim 1, wherein, between the actuating element (30) and the transmission element (20), a locking disk (40) is provided, which has an opening (41) with a shape which allows the extension (32) of the actuating element (30) to pass through in at least one of its predetermined rotational positions.

3. Actuating device according to claim 2, wherein, in the unlocking position (31") of the rotatable area (31) of the actuating element (30), its extension (32"), when actuated, can pass through the opening (41) in the locking disk (40), whereas this extension, when in the locking position (32') collides, when actuated, with the locking plate (40).

4. Actuating device according to claim 1, wherein the actuating element is a push button (30) with the capacity for linear movement.

5. Actuating device according to claim 4, wherein the second securing device is a cylinder lock, which is integrated into the push button (30) and can be locked and unlocked with the help of a mechanical key (35).

6. Actuating device according to claim 5, wherein a projection (51) is provided in the motor vehicle in the vicinity of the push button (30) to prevent the push button (30) from being pushed in when the lock is in its locking position by blocking the path of the mechanical key (35).

7. Actuating device according to claim 5, wherein an additional rotational position (31'") of the rotatable area (31) of the actuating element (30) is provided, in which the end surface (33'") of its extension (32'") overlaps the end surface (23') of the shaft extension (22') in its locking position (22').

8. Actuating device according to claim 7, wherein the mechanical key (35) cannot be pulled out in the additional rotational position (31'") of the rotatable area (31) of the actuating element (30).

9. Actuating device according to claim 7, wherein, in the additional rotational position (31'") of the rotatable area (31) of the actuating element (30), its extension (32'"), when actuated, can pass through the opening (41) in the locking plate.

10. Actuating device according to claim 1, wherein the end surface (33) of the extension (32) of the actuating element (30) lies in only one of the four quarter-planes separated from each other by two straight lines intersecting the rotational axis and each other at right angles.

11. Actuating device according to claim 10, wherein the end surface (33) of the extension (32) of the actuating element (30) has approximately the shape of a quarter-circle, where the point is set back slightly from the rotational axis.

12. Actuating device according to claim 1, wherein the shaft (20) can be turned to an unlocking position (20") and to a locking position (20') approximately 90° away.

13. Actuating device according to claim 1, wherein the rotatable area (31) of the actuating element (30) can be turned to an unlocking position (31") and to a locking position (31') approximately 90° away.

14. Actuating device according to claim 1, wherein the second securing device is an electrical lock.

15. Actuating device according to claim 1, wherein the locking and unlocking positions of the shaft (20', 20") and of the rotatable area (31', 31") of the actuating element (30) are coordinated with each other in such a way that the end surfaces (23, 33) of their extensions (22, 32) do not overlap each other when one of the elements is in its locking position.

16. Actuating device according to claim 1, wherein the end surface (23) of the shaft extension (22) lies in only one of two half-planes separated from each other by a straight line intersecting the rotational axis at a right angle.

17. Actuating device according to claim 16, wherein the end surface (23) of the shaft extension (22) is approximately in the shape of a segment of a circle, where the chord of the segment of a circle is set slightly back from the straight line intersecting the rotational axis.

18. Actuating device according to claim 1, wherein the locking disk (40) is mounted nonrotatably.

19. Actuating device according to claim 1, wherein the first securing device is a central locking device (11).

20. Actuating device according to claim 1, wherein at least a certain area of the locking disk (40) is designed as an integral part of a housing (10).

* * * * *

UNITED STATES PATENT AND TRADEMARK OFFICE

CERTIFICATE OF CORRECTION

PATENT NO. : 6,886,381 B2
DATED : May 3, 2005
INVENTOR(S) : Armin Geurden

It is certified that error appears in the above-identified patent and that said Letters Patent is hereby corrected as shown below:

Title page,
Item

Signed and Sealed this

Sixteenth Day of August, 2005

JON W. DUDAS
*Director of the United States Patent and Trademark Office*

UNITED STATES PATENT AND TRADEMARK OFFICE

CERTIFICATE OF CORRECTION

PATENT NO. : 6,886,381 B2
DATED : May 3, 2005
INVENTOR(S) : Armin Geurden

It is certified that error appears in the above-identified patent and that said Letters Patent is hereby corrected as shown below:

Title page,
Insert Item -- [30] Foreign Application Priority Data
June 27, 2000 (DE) Germany……..100 31 249 --.

Signed and Sealed this

Eighth Day of November, 2005

JON W. DUDAS
*Director of the United States Patent and Trademark Office*